US010123924B2

(12) United States Patent
Chiacchira et al.

(10) Patent No.: US 10,123,924 B2
(45) Date of Patent: Nov. 13, 2018

(54) SYSTEM AND METHOD FOR AUTOMATICALLY ADJUSTING THE HEIGHT OF A PATIENT SUPPORT

(71) Applicant: Hill-Rom S.A.S., Pluvigner (FR)

(72) Inventors: Mark Chiacchira, Lawrenceburg, IN (US); David Guyot, Landaul (FR); Etienne Yvernault, Locoal Mendon (FR)

(73) Assignee: Hill-Rom S.A.S., Pluvigner (FR)

( * ) Notice: Subject to any disclaimer, the term of this patent is extended or adjusted under 35 U.S.C. 154(b) by 181 days.

(21) Appl. No.: 14/539,101

(22) Filed: Nov. 12, 2014

(65) Prior Publication Data

US 2015/0135440 A1 May 21, 2015

(30) Foreign Application Priority Data

Nov. 15, 2013 (EP) ..... 13306564

(51) Int. Cl.
*A61G 7/018* (2006.01)
*A61G 7/012* (2006.01)
*A61G 7/015* (2006.01)

(52) U.S. Cl.
CPC ..... *A61G 7/018* (2013.01); *A61G 7/012* (2013.01); *A61G 7/015* (2013.01); *A61G 2203/12* (2013.01); *A61G 2203/726* (2013.01)

(58) Field of Classification Search
CPC ..... A61G 13/02; A61G 13/06; A61G 13/08; A61G 2203/12; A61G 2203/726;
(Continued)

(56) References Cited

U.S. PATENT DOCUMENTS 4,062,075 A 12/1977 Stern et al.
5,060,896 A 10/1991 Hobbins
(Continued)

FOREIGN PATENT DOCUMENTS

EP 0403073 A2 12/1990
EP 0406178 A2 1/1991
EP 2181685 B1 9/2003

OTHER PUBLICATIONS

European Search Report, dated Apr. 2, 2014, for EP Application No. EP 13 30 6564 (6 pages).

*Primary Examiner* — Nicholas F Polito
*Assistant Examiner* — Amanda L Bailey
(74) *Attorney, Agent, or Firm* — Barnes & Thornburg LLP

(57) ABSTRACT

A system for adjusting the height of a patient support surface on a bed includes one or more height adjustment actuators operable to adjust a height of the patient support surface above a floor surface; a controller connected to the one or more height adjustment actuators, the controller including a memory; and one or more user interface units connected to the controller, wherein the controller is configured to record as a stored actuator state a current state of the one or more height adjustment actuators in the memory in response to a first input signal from the one or more interface units, and is configured to operate the one or more height adjustment actuators to automatically return them to the stored actuator state in response to a second input signal from the one or more interface units. Alternatively, or in addition, the controller may be configured to provide an indication to a user when the one or more height adjustment actuators have returned to the stored actuator state during a subsequent height adjustment operation.

17 Claims, 8 Drawing Sheets

(58) Field of Classification Search
CPC .... A61G 2203/70; A61G 7/018; A61G 7/012; A61G 7/015
See application file for complete search history.

(56) References Cited

U.S. PATENT DOCUMENTS

| | | | | |
|---|---|---|---|---|
| 5,600,214 | A | 2/1997 | Fromson | |
| 5,715,548 | A | 2/1998 | Weismiller et al. | |
| 5,774,915 | A * | 7/1998 | Scott | A61G 13/009 5/610 |
| 5,790,997 | A | 8/1998 | Ruehl | |
| 6,008,598 | A | 12/1999 | Luff et al. | |
| 6,056,353 | A | 5/2000 | Meara | |
| 6,155,641 | A | 12/2000 | Frost | |
| 6,347,420 | B2 | 2/2002 | Elliott | |
| 6,351,678 | B1 | 2/2002 | Borders | |
| 6,516,480 | B2 | 2/2003 | Elliott | |
| 6,721,980 | B1 | 4/2004 | Price et al. | |
| 6,854,141 | B2 | 2/2005 | Nagaoka et al. | |
| 6,870,341 | B2 | 3/2005 | Nagaoka et al. | |
| 6,957,458 | B2 | 10/2005 | Nagaoka et al. | |
| 6,957,459 | B2 | 10/2005 | Nagaoka et al. | |
| 6,957,460 | B2 | 10/2005 | Horitani | |
| 7,036,166 | B2 | 5/2006 | Kramer et al. | |
| 7,058,999 | B2 | 6/2006 | Horitani et al. | |
| 7,174,586 | B2 | 2/2007 | Nagaoka | |
| 7,235,942 | B2 | 6/2007 | Nagaoka et al. | |
| 7,253,366 | B2 | 8/2007 | Bhai | |
| 7,296,312 | B2 | 11/2007 | Menkedick et al. | |
| 7,319,386 | B2 | 1/2008 | Collins, Jr. et al. | |
| 7,330,127 | B2 | 2/2008 | Price et al. | |
| 7,458,119 | B2 | 12/2008 | Hornbach et al. | |
| 7,512,998 | B2 | 4/2009 | Martin et al. | |
| 7,515,059 | B2 | 4/2009 | Price et al. | |
| 7,538,659 | B2 | 5/2009 | Ulrich et al. | |
| 10,638,132 | | 11/2009 | Kramer et al. | |
| 7,644,460 | B2 | 1/2010 | Calvo | |
| 7,779,547 | B2 | 8/2010 | Townsend | |
| 7,797,771 | B1 | 9/2010 | Bossen et al. | |
| 7,941,881 | B2 * | 5/2011 | Hayes | A61G 7/018 5/11 |
| 8,028,359 | B2 | 10/2011 | Parson et al. | |
| 8,051,512 | B2 | 11/2011 | Teeter | |
| 8,065,024 | B2 | 11/2011 | Nagaoka et al. | |
| 8,068,924 | B2 | 11/2011 | Nagaoka et al. | |
| 8,127,380 | B2 | 3/2012 | Wurdeman | |
| 8,413,273 | B2 | 4/2013 | Hornbach et al. | |
| 8,499,385 | B2 | 8/2013 | Horitani | |
| 8,844,078 | B2 | 9/2014 | Hornbach et al. | |
| 9,173,793 | B2 * | 11/2015 | Rawls-Meehan | A61H 23/0263 |
| 2004/0189073 | A1 | 9/2004 | Chadwick et al. | |
| 2005/0172404 | A1 * | 8/2005 | Diller | A61G 13/02 5/616 |
| 2005/0172405 | A1 * | 8/2005 | Menkedick | A61B 5/1115 5/618 |
| 2007/0169268 | A1 | 7/2007 | Lemire et al. | |
| 2007/0210917 | A1 | 9/2007 | Collins, Jr. et al. | |
| 2008/0092292 | A1 | 4/2008 | Rawls-Meehan | |
| 2008/0201851 | A1 | 8/2008 | Menkedick et al. | |
| 2009/0000033 | A1 | 1/2009 | Hempker | |
| 2009/0038074 | A1 | 2/2009 | Barthelt | |
| 2009/0044334 | A1 | 2/2009 | Parsell et al. | |
| 2009/0094745 | A1 | 4/2009 | Benzo et al. | |
| 2009/0212925 | A1 | 8/2009 | Schuman, Sr. et al. | |
| 2009/0212926 | A1 | 8/2009 | Du et al. | |
| 2009/0217080 | A1 | 8/2009 | Ferguson et al. | |
| 2010/0064439 | A1 | 3/2010 | Sultani | |
| 2010/0244522 | A1 | 9/2010 | Fukai | |
| 2010/0293718 | A1 | 11/2010 | Wurdeman | |
| 2011/0047704 | A1 | 3/2011 | DeBraal et al. | |
| 2011/0214234 | A1 * | 9/2011 | Herman | A61G 7/0507 5/600 |
| 2011/0277242 | A1 | 11/2011 | Dionne et al. | |
| 2012/0023673 | A1 | 2/2012 | Hornbach | |
| 2012/0047655 | A1 | 3/2012 | O'Keefe | |
| 2012/0060290 | A1 | 3/2012 | Jones et al. | |
| 2012/0073053 | A1 * | 3/2012 | Turner | A61G 7/015 5/618 |
| 2012/0116591 | A1 | 5/2012 | Rawls-Meehan | |
| 2013/0219622 | A1 | 8/2013 | Hornbach et al. | |
| 2013/0318720 | A1 * | 12/2013 | Connell | A61G 7/018 5/611 |

* cited by examiner

SYSTEM AND METHOD FOR AUTOMATICALLY ADJUSTING THE HEIGHT OF A PATIENT SUPPORT

CROSS-REFERENCE TO RELATED APPLICATIONS

The present application claims priority, under 35 U.S.C. § 119(a), of European Application No. 13306564.9 which was filed Nov. 15, 2013 and which is hereby incorporated by reference herein.

BACKGROUND

The present disclosure relates to height adjustable patient supports and in particular, to a system and method for automatically adjusting a patient support to a preferred height specific to a particular user.

Modern hospital beds typically have height adjustment mechanisms and articulation mechanisms, allowing the patient support surface of the bed to assume different configurations at different distances from the floor. The reason for this is that the ideal height and configuration of the patient support depends on whether the patient is resting or interacting with others, is being moved onto or out of the bed, or is getting into or out of the bed unaided. For example, the ideal height for the patient support surface when the patient is getting out of the bed, referred to as bed egress, (or for getting into the bed which is referred to as bed ingress) is lower than the height that is ideal for caregivers providing care. In the following text, when reference is made to bed egress, bed ingress is also intended.

Typically, the adjustment mechanisms are electrically powered and operated using keys, or one or more user interfaces, provided on the bed. The patient or caregiver adjusts the height of the bed as required in the circumstances. The ideal height for patient egress depends on the size of the patient, so the patient or caregiver must judge when the ideal height has been reached each time the height of the bed is adjusted.

It would be desirable to provide a system and method for adjusting the height of a patient support surface that is more efficient and relies less on caregiver judgment and effort.

SUMMARY

An apparatus, system and/or method according to the present disclosure includes one or more of the features recited below or in the appended claims, and which alone, or in any combination, may define patentable subject matter:

In a first aspect, there is provided a system for adjusting the height of a patient support surface on a bed, comprising: one or more height adjustment actuators operable to adjust a height of the patient support surface above a floor surface; a controller connected to the one or more height adjustment actuators, the controller including a memory; and one or more user interface units connected to the controller, wherein the controller is configured to record as a stored actuator state a current state of the one or more height adjustment actuators in the memory in response to a first input signal from the one or more interface units, and is configured to operate the one or more height adjustment actuators to automatically return them to the stored actuator state in response to a second input signal from the one or more interface units.

The system has the feature, in some embodiments, that after an initial operation to decide on and store a desired height of the patient support surface, for example for patient egress, only a single user input is required to return the patient support to that height. For a caregiver, this removes significant time and effort adjusting the patient support and judging when an ideal height has been reached.

Alternatively, or in addition, the controller may be configured to provide an indication to a user when the one or more height adjustment actuators have returned to the stored actuator state during a subsequent height adjustment operation.

Again, for a caregiver, this removes significant time and effort judging when an ideal height has been reached for a particular patient, which can be difficult when the patient is still in a lying position.

The system may comprise an articulated deck on which the patient support surface is positioned, and an intermediate frame, wherein the articulated deck comprises a plurality of sections which may be moved relative to one another and which are supported by the intermediate frame, wherein the height adjustment actuators are arranged to adjust the height of the intermediate frame above the floor, and wherein the controller is configured to store the state of the height adjustment actuators independently of the state of position of the sections of the deck. For example, the deck may have a head support section, a seat support section and a leg support section. The deck may be mounted to an intermediate frame and deck actuators mounted between the intermediate frame and the head support and leg support deck sections. The one or more height adjustment actuators may be positioned between the intermediate frame and a base frame or sets of caster wheels that rest on the floor. The state of the height adjustment actuators is stored without storing the state of the deck actuators. The stored actuator state for bed egress it is not selected as a position of the patient support that the patient finds comfortable. It is a height selected by the caregiver based on their expertise and experience.

The position of the deck sections relative to the intermediate frame may be automatically controlled to return to a set position for bed egress or ingress, which cannot be altered by the patient. Alternatively, the position of the deck sections may be controlled by a user (which could be the caregiver) for bed egress or ingress. Optionally, the position of the deck sections are adjusted after the patient support surface has reached the bed egress or ingress height. Moving the patient support surface in its flat, level or unarticulated position to the bed egress height before then articulating the deck section by, for example, raising the deck head support section to help the patient into a sitting position and thereby aid bed egress makes for a more comfortable and safe bed egress and ingress.

In some embodiments, the one of more interface units are positioned on a surface facing towards the caregiver in use. In such embodiments, it is beneficial that that the stored actuator state can be set by the caregiver as they have expertise and experience in determining an optimum bed height that a patient will likely not have.

The one or more user interface units may comprise a first input element, wherein actuation of the first input element generates the first input signal. The first input element may be a dedicated memory key or button provided on one of the interface units, and in particular an interface unit positioned conveniently for a caregiver when adjusting the height of the patient support surface. In some embodiments, the interface units having a first input element cannot be readily accessed by a patient on the patient support surface.

It is desirable, in some embodiments, that the storing of a desired height in the memory should be a deliberate action that is unlikely to be performed by mistake. Accordingly, the first input signal may be generated only with continuous actuation of the first input element for a first period. For example, the first input signal may be a continuous signal of 5 seconds duration. Only after such a continuous signal has been received will the controller then store the current state of the height adjustment actuators as the stored actuator state.

The one or more user interface units may comprise a second input element, wherein actuation of the second input element generates the second input signal. The second input signal may be generated in response to a request to position the bed for bed egress. The second input element may be dedicated solely to bed egress in some embodiments. As explained, the controller may also operate other actuators in response to the second input signal, such as a deck actuator arranged to move a head support section of the patient support relative to a predetermined position relative to an intermediate frame, to put the patient into a sitting position. In this way, a single input element may be used to select the best possible configuration of the patient support for bed egress.

The controller may be configured so that operation of the one or more height adjustment actuators is stopped if an input signal is not being received. So, for example, if the second input element is actuated the height adjustment actuators may be operated to move towards the stored actuator state, but if the second input element is released before the stored actuator state is reached, the height adjustment actuators may stop moving. This allows the movement of the patient support surface to be immediately stopped if desired, simply by releasing the input elements.

The one or more user interface units may comprise one or more height adjustment input elements that may be used to position the patient support surface to any desired height, wherein actuation of the height adjustment input elements generates a height adjustment input signal, and wherein the controller is configured to operate the one or more height adjustment actuators in response to the height adjustment input signal. The system may then provide an indication to the caregiver when the stored actuator state is reached. The indication that the one or more height adjustment actuators have returned to the stored actuator state may be a pause in the operation of the height adjustment actuators while a height adjustment input signal is being generated. For example, the caregiver may continuously depress a height adjustment input element to lower the height of the patient support surface. When the stored actuator state, corresponding to a bed egress height, is reached, the controller may pause operation of the height adjustment actuators for a short time, say 5 seconds, even though the caregiver continues to depress the height adjustment input element. This indicates to the caregiver that the stored height of the patient support surface has been reached. The caregiver can then choose to release the height adjustment input element to stay at the stored height, or may continue to depress the height adjustment input element in order to the lower the height of the patient support surface further.

The indication may alternatively, or in addition, comprise an audible, tactile or visual indication. For example, when the one or more height adjustment actuators have returned to the stored actuator state a light may be turned on or may flash on the one or more interface units (or elsewhere on the bed), a buzzer may sound, or the interface unit may vibrate. A combination of these indications, or any other suitable indications, may be used.

The system may be part of a hospital bed. The hospital bed may be a long-term care bed. Typically, modern hospital beds can be moved into various configurations, including tilting the patient support surface into tilted positions, such as the Trendelenburg position, in which the head end is lower than the foot end, and the reverse Trendelenburg position in which the foot end is lower than the head end. If there is more than one height adjustment actuator, the height adjustment actuators may be used to provide tilted positions for the patient support surface. However, a tilted support surface is not ideal for bed egress. So, the controller may be configured to such that it does not record as a stored actuator state a current state of the one or more actuators if the patient support surface is tilted away from a horizontal orientation by greater than a predetermined tilt angle.

Furthermore, the controller may be configured to such that it does not record as a stored actuator state a current state of the one or more actuators if the patient support surface is above a maximum height threshold. This prevents erroneous setting of the height for bed egress at a height that is unsuitable for even the tallest of patients that could fit the patient support surface. Similarly, the controller may be configured to such that it does not record as a stored actuator state a current state of the one or more actuators if the patient support surface is below a minimum height threshold.

It is, of course, possible for the memory to store more than one actuator state to be used for different circumstances. For example, as well as patient egress height, a preferred sitting configuration may be stored and a dedicated sitting input may be provided on the one or more interface units which can be used to automatically return the patient support surface to the stored sitting configuration. However, this function would be provided for storing the position of the deck actuators and would be controllable by the patient.

The height adjustment actuators may be electrically powered and controlled linear actuators. The actuators may be powered by brushless DC motors. The state of the height adjustment actuators may be calculated as a difference from an initial state of the actuators. Alternatively, any one or more of the height adjustment actuators and deck actuators may be another type of electric actuator, pneumatic actuator, hydraulic actuator, mechanical actuator, link system or other component known to those of ordinary skill in the art for coordinating movement of components relative to one another.

The controller may be any suitable programmable logic controller or microprocessor, and may be a general-purpose controller that is programmed to operate as required.

In another aspect of the present disclosure, there is provided a method for adjusting the height of a patient support surface, comprising: adjusting the height of the patient support surface to a desired height in response to a first user input; storing the desired height in a memory storage device in response to a second user input; and subsequently automatically returning the patient support surface to the desired height from a different height in response to a third user input.

In a further aspect, there is provided a method for adjusting the height of a patient support surface, comprising: adjusting the height of the patient support surface to a desired height in response to a first user input; storing the desired height in a memory storage device in response to a second user input; and providing an indication to a user when the patient support surface has returned to the desired height during a subsequent adjustment of the height of the patient support surface.

In some embodiments, the first user input is provided on a caregiver interface that cannot readily be accessed by a patient on the patient support surface. In some embodiments, the desired height is stored in the memory storage device independently of any other data relating to the configuration of the patient support surface.

The indication that the patient support surface has returned to the desired height may be a pause in the operation of actuators used to adjust the height of the patient support surface. The indication may alternatively, or in addition, comprise an audible, tactile or visual indication. For example, when the one or more height adjustment actuators have returned to the stored actuator state a light may be turned on or may flash on the one or more interface units (or elsewhere on the bed), a buzzer may sound or the interface unit may vibrate. A combination of these indications, or any other suitable indications, may be used.

The method may further comprise preventing storage of the desired height in the memory storage device in response to a second user input if the patient support surface is tilted away from a horizontal orientation by greater than a predetermined tilt angle.

The method may further comprise preventing storage of the desired height in the memory storage device in response to a second user input if the patient support surface is above a maximum height threshold.

The method may further comprise preventing storage of the desired height in the memory storage device in response to a second user input if the patient support surface is below a minimum height threshold.

The present disclosure in a further aspect provides a method for adjusting the bed egress or ingress height of a patient support surface, comprising: adjusting the height of the patient support surface to a desired bed egress and/or ingress height in response to a first user input; storing the desired height in a memory storage device in response to a second user input; and subsequently automatically returning the patient support surface to the desired height from a different height in response to a third user input and then subsequently articulating the patient support surface to raise the head section of the patient support surface.

Additional features, which alone or in combination with any other feature(s), such as those listed above and/or those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

Illustrative embodiments will now be described in detail, by way of example only, with reference to the accompanying drawings, in which.

DETAILED DESCRIPTION

Figure 1:
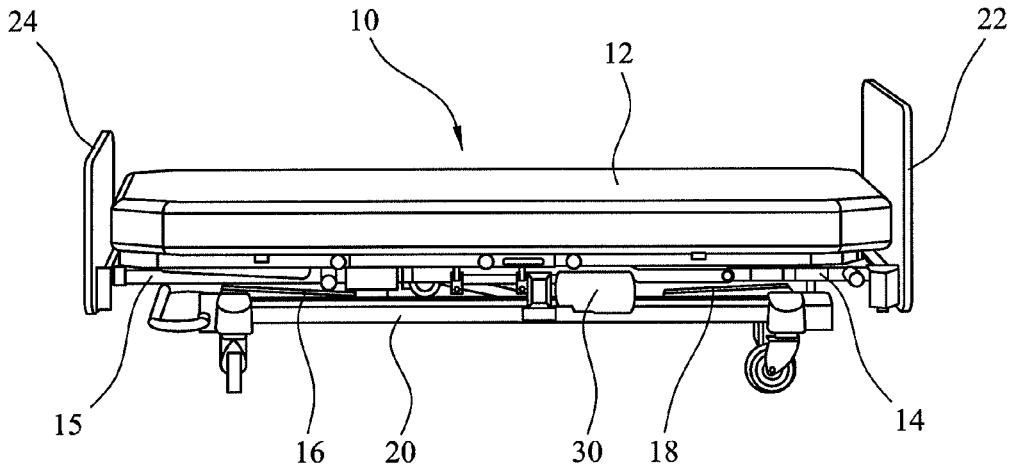
FIG. 1 shows a bed in accordance with an embodiment of the present disclosure in a low position.

FIG. 1 shows a long-term care bed 10 in accordance with the present disclosure. The bed comprises a patient support surface 12, which is a mattress that may incorporate various functional components such as inflatable bladders. The patient support surface is positioned on an articulated deck 14, which is supported on an intermediate frame 15. The bed is supported on the floor by two sets of caster wheels 20. A lift mechanism is included, comprising two pairs of lift arms 16, 18 that extend between the sets of casters 20 and the intermediate frame 15.

Figure 2:
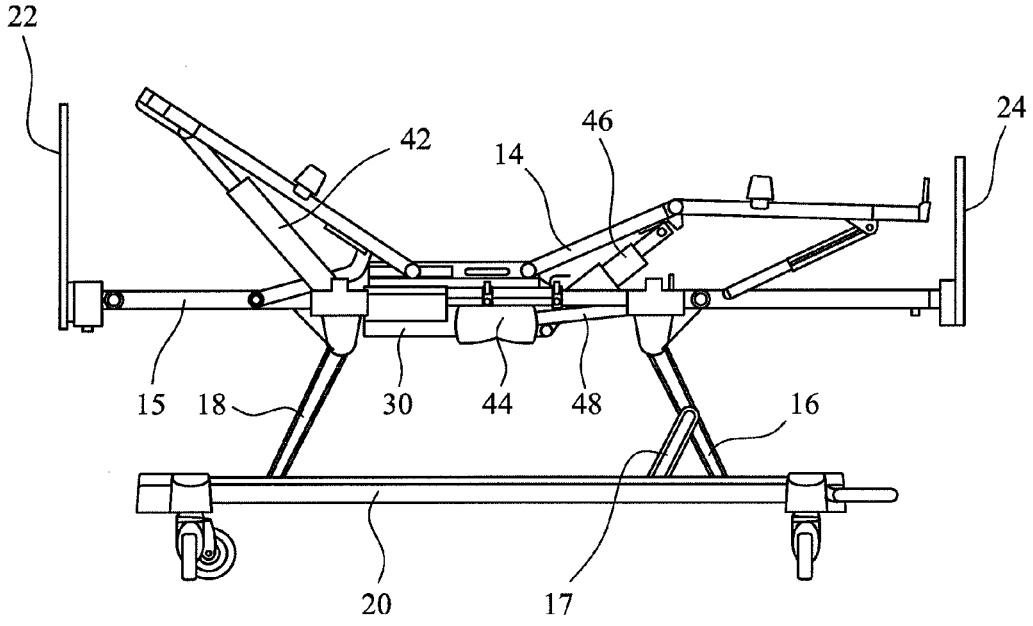
FIG. 2 shows the bed of FIG. 1 with the patient support surface removed, showing the height adjustment actuators and the deck actuators.

As shown in FIG. 1, the bed is in a low position, with the lift arms collapsed to lie almost parallel to the intermediate frame 15. FIG. 2 illustrates the bed in a raised position, with the mattress removed.

The lift arms 16, 18 can be raised to raise the height of the patient support surface above the floor. In this embodiment, the lifts arms are driven by a pair of height adjustment linear actuators 44, 48 mounted to the intermediate frame 15. An upper end of each of the lift arms is pivotally connected to the intermediate frame. The linear actuators are coupled to the upper ends of the lift arms by extension links so that extension of retraction of the linear actuators 44, 48 rotates the upper ends of the lift arms. A lower end of each lift arm is slidable along a base frame 20 to which caster wheels are mounted. A link arm 17 is pivotally fixed to the base frame and to a mid-point of lift arm 16 to ensure that the lift arms do not undesirably slide along the base frame 20. The linear actuators 44, 48 can be operated independently so that the intermediate frame can be raised, lowered and tilted. The linear actuators in this embodiment are Linak actuators, Model No. LA27, available from LINAK U.S. Inc. located at 2200 Stanley Gault Parkway, Louisville Ky. 40223.

This type of lift mechanism is well known in the art, and is described for example in EP2181685, but any suitable lift mechanism may be used to raise and lower the height of the patient support surface.

The articulated deck is 14 is also equipped with deck actuators to allow the sections of the deck to be independently moved relative to the intermediate frame 15. In this embodiment, the deck is provided with one actuator 42 for moving a head support section of the deck and another actuator 46 for moving a leg support section of the deck. The deck actuators 42, 46 are also linear actuators, similar to the height adjustment linear actuators. This allows a patient to be supported in a sitting position and to have their legs elevated, as shown in FIG. 2.

This type of articulated deck arrangement is well known in the art. An example of a sophisticated articulated deck is described in detail in EP2181685. However, any type of deck may be used with the present invention.

The bed is provided with a caregiver interface unit 30. The caregiver interface unit is positioned on the side of the bed so that it can be easily accessed by a caregiver but cannot easily be accessed by a patient on the patient support surface. The caregiver interface unit 30 includes keys or buttons allowing the caregiver to adjust the height of the patient support surface and to adjust the configuration of the articulated deck 14. Additional user interface units may be provided elsewhere on the bed, or as a remote control. In this embodiment, an identical user interface unit is positioned on the opposite side of the bed and a different user interface unit is provided for the patient on a siderail (not shown).

Figure 6B:
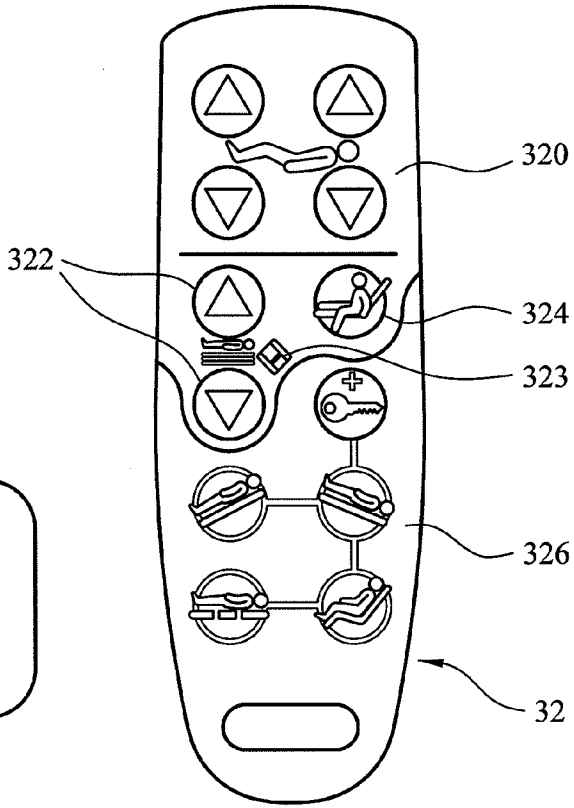
FIGS. 6*a* and 6*b* show exemplary interface units for the bed of FIG. 1.
Figure 6A:
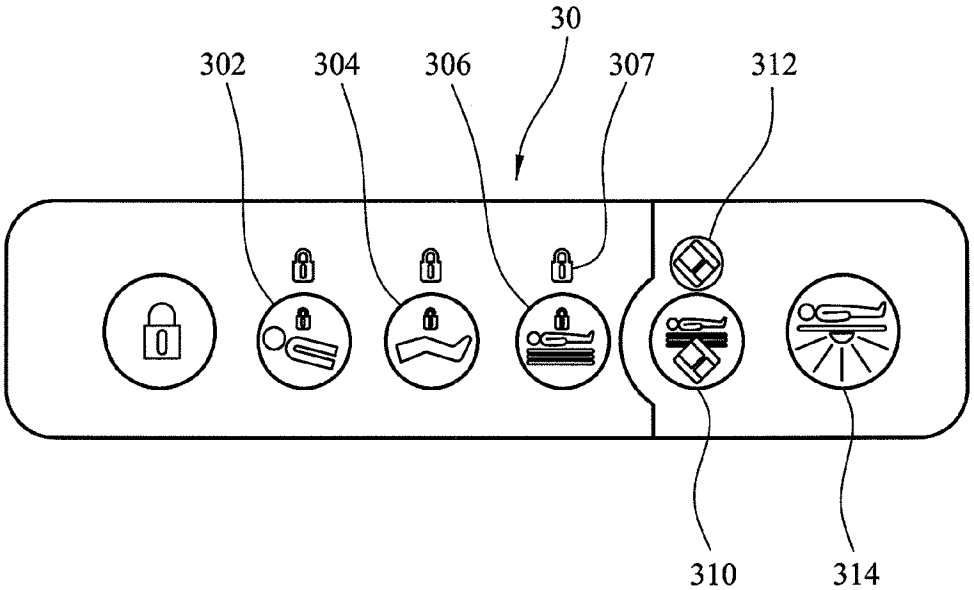

FIGS. 6*a* and 6*b* show example user interface units. FIG. 6*a* illustrates the caregiver interface 30 provided on the side of the bed for use by the caregiver. The caregiver interface 30 includes keys 302, 304, 306 allowing the caregiver to lock the attitude of the head section of the deck and the leg section of the deck and to lock the height of the patient support surface. A memory key 310 is provided to allow a particular height of the patient support to be stored as a desired height for patient egress, as will be described. A key 314 for an under bed light is also provided for the caregiver. FIG. 6*b* shows a user interface that is intended for use by both the caregiver and the patient. It includes keys 320, 322 allowing for adjustment of the attitude of the deck sections and for the adjustment of the height of the patient support surface. It also includes a patient egress key 324. A further set of keys 326 is provided for caregiver use only, for putting the patient into particular positions for caregiver procedures, such as the Trendelenburg position.

Figure 3:
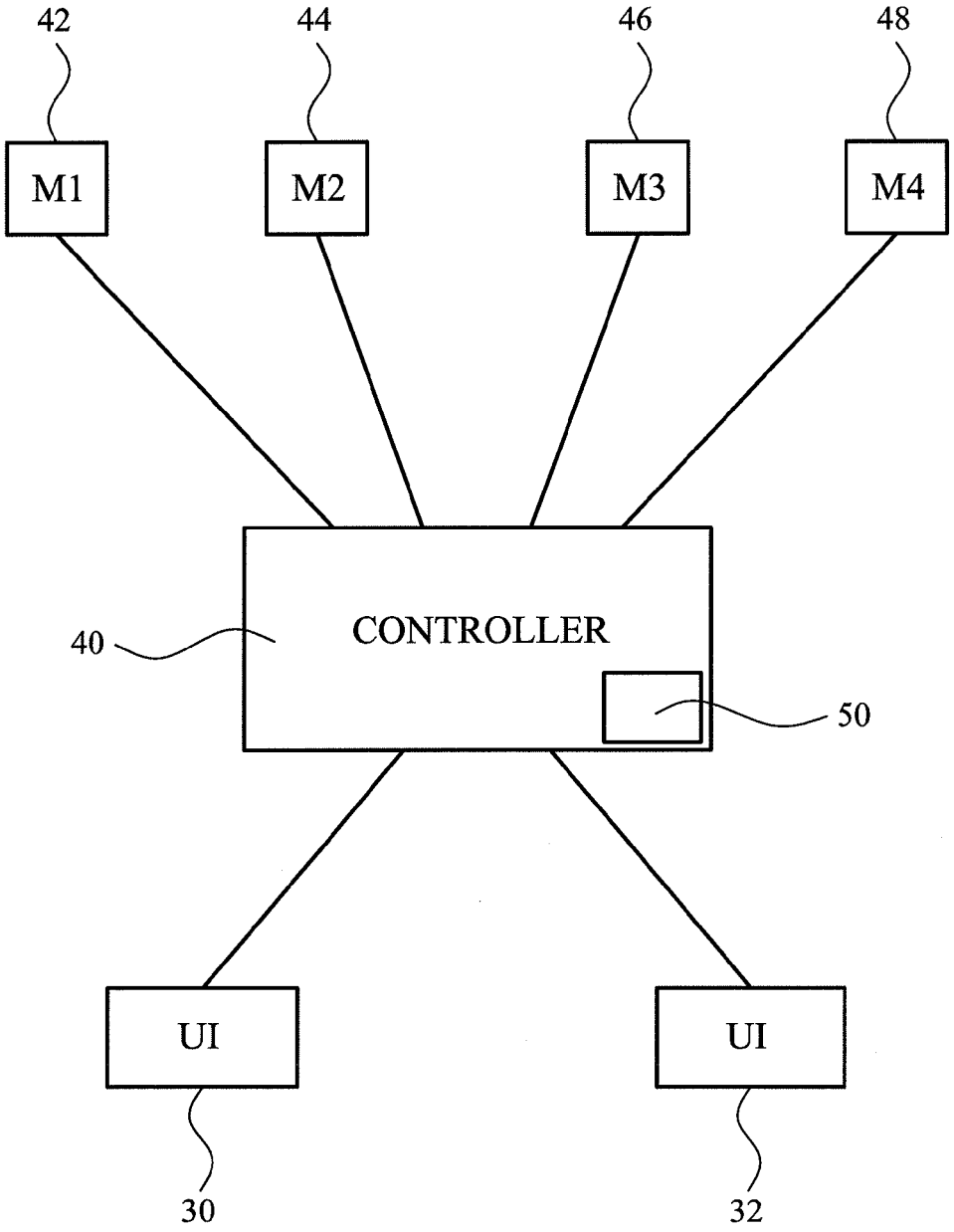
FIG. 3 is a schematic diagram of the control elements of the height adjustment system of the bed of FIG. 1.

The bed includes a controller 40 that controls the operation of the various bed functions, including the height adjustment actuators, in response to signals from the user interface units. FIG. 3 is a schematic diagram of the control system. The controller 40 receives input signals from user interface units 30, 32. The controller comprises one or more programmable logic controllers (PLCs) and includes a memory 50. Memory 50 in this embodiment is a non-volatile memory, such as EEPROM. The controller 40 sends control signals to each of the actuators 42, 44, 46, 48, referred to as M1, M2, M3 and M4, to control the height and configuration of the patient support surface. In this embodiment, M2 and M4 are height adjustment actuators and M1 and M3 are deck adjustment actuators.

Figure 4:
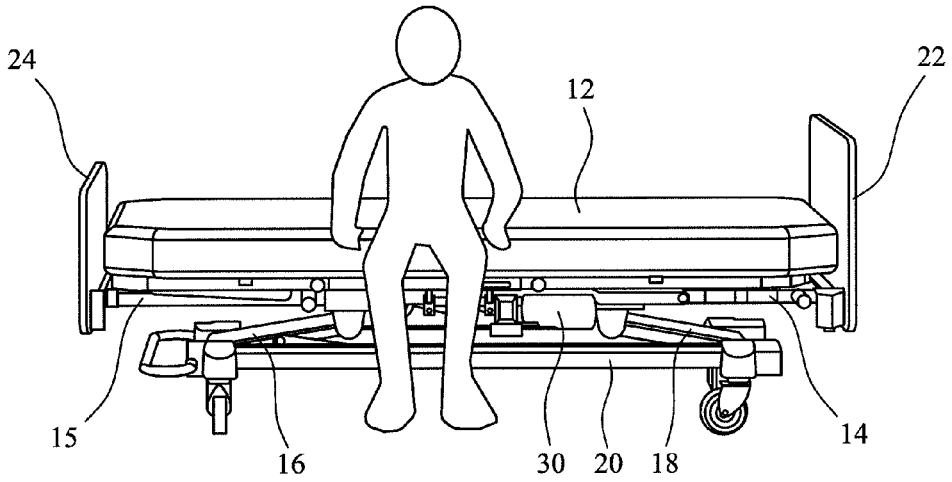
FIG. 4 shows the bed of FIG. 1 adjusted to a height for patient egress.

FIG. 4 shows the bed of FIG. 1 with the patient support surface 12 raised to a height ideal for patient egress. In this position, the patient 1, shown schematically, can sit on the side of the bed with their feet flat on the floor. The ideal position depends on the height of the patient and so may differ dramatically from patient to patient.

Figure 5:
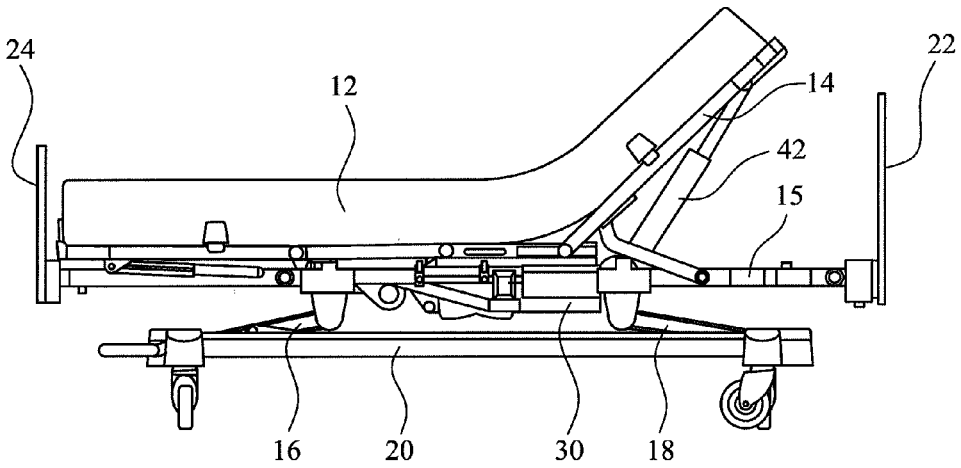
FIG. 5 shows the bed of FIG. 1 in a patient egress position.

FIG. 5 shows the bed of FIG. 1 with the patient support surface 12 ideally configured for patient egress. The bed is at the height shown in FIG. 4, but the head section of the deck 14 is raised so that the patient is brought into a sitting position before getting out of the bed.

Figure 7A:
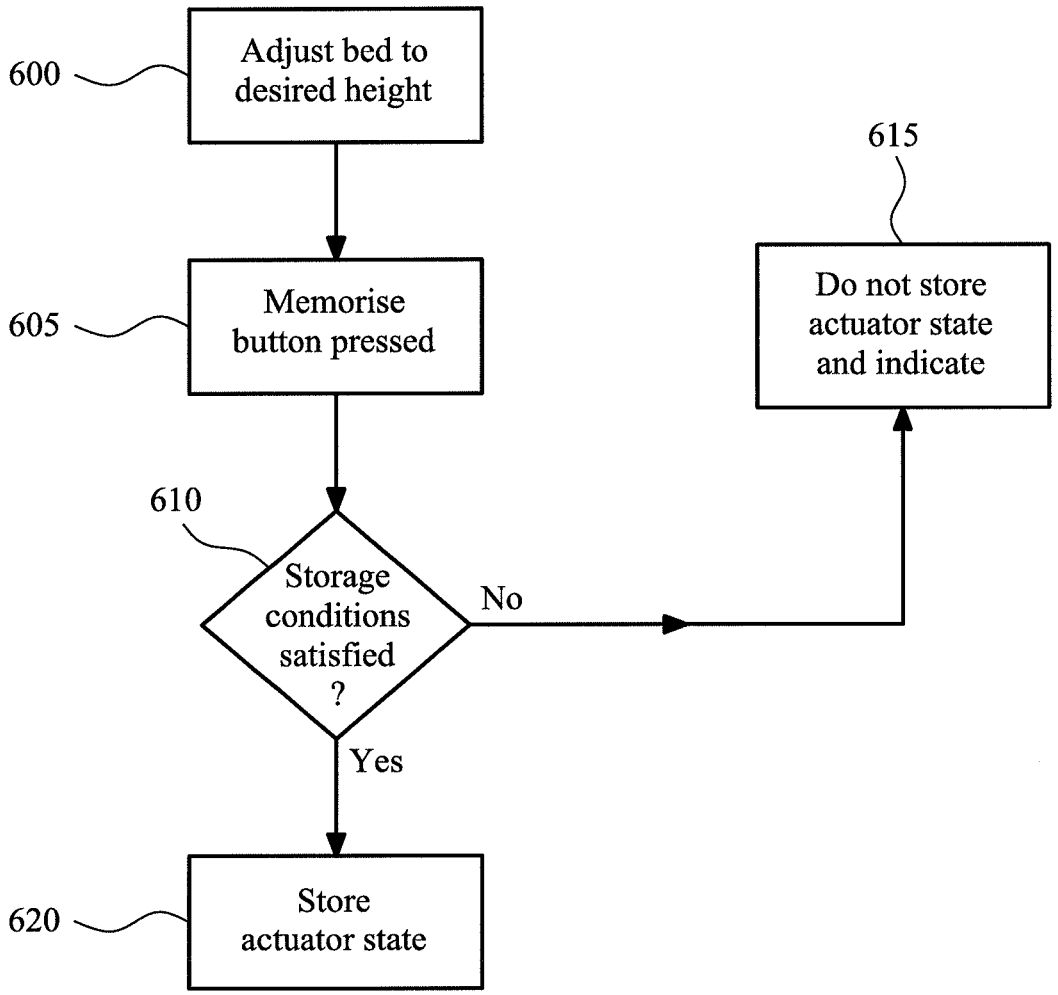
FIG. 7*a* is a flow diagram of the process for storing a bed egress height.

Operation of the height adjustment mechanism of the bed and operation of the bed egress function will now be described. FIG. 7*a* illustrates the process for storing a bed egress height. In a first step 600, the caregiver presses the height adjustment keys 322 to place the patient support surface 12 at the desired height. The controller 40 is configured so that the height adjustment actuators M2 and M4 are not operated unless a corresponding input signal is being received by the controller. In other words, one of the keys on one of the interface units must be being depressed for the actuators to move. If the keys are released, the actuators stop moving. This ensures that, in an emergency, movement of the patient support surface 12 can be stopped immediately, simply by releasing the keys.

Once the caregiver has the patient support surface 12 at the desired height, they depress the memory key 310 on the interface unit 30 in step 605. While the memory key 310 is being depressed, the memory key indicator 312 flashes. However, the state of the actuators M2 and M4 is not stored in memory 50 until all the necessary conditions are satisfied. One of these conditions is that the memory key 310 has been continuously depressed for five seconds (although any suitable period may be chosen). In step, 610 the controller 40 determines whether the memory key 310 has been pressed continuously for five seconds. While the memory key is being depressed, the memory key indicator 312 flashes. Once the memory key has been pressed continuously for five seconds, and all other necessary conditions have been satisfied, the state of the height adjustment actuators M2 and M4 is stored in step 620. At this point, the memory key indicator 312 is illuminated constantly for 10 seconds to show that memorization has been successful. If the memory key 310 is released before five seconds has passed, then the state of the height adjustment actuators is not stored, as represented by step 615 in FIG. 6*a*.

The other necessary conditions that are checked in step 610 are related to the state of the height adjustment actuators themselves. The controller 40 is configured so that the state of the height adjustment actuators M2 and M4 is not stored in memory 50 if the patient support surface 12 is excessively tilted. In particular, if the intermediate frame 15 has been tilted to place the patient support surface in a Trendelenburg or reverse Trendelenburg orientation, the controller 40 will not store the actuator states because such a tilted orientation of the patient support surface is not ideal for bed egress. In this embodiment, the degree of tilt is determined in step 610 by the difference in the state of the first height adjustment actuator M2 and the second height adjustment actuator M4. If the stroke of the first height adjustment actuator differs from the stroke of the second height adjustment actuator by more than 20 mm (corresponding to ±2° from horizontal), then the actuator states are not stored in the memory 50, as indicated in step 615. Instead, the indicator 307 flashes and a buzzer sounds while the memory key 310 is being depressed. The stroke of the actuator is the distance the linear actuator travels from an initial position set as a default during manufacture.

Also, as part of step 610, the controller 40 is configured to check if any of the height adjustment actuators is moving, and to prevent the storage of the state of the height adjustment actuators if one of the actuators is moving. In this circumstance, indicator 307 flashes and a buzzer sounds while the memory key 310 is being depressed.

The controller 40 is also configured to prevent storage of the state of the height adjustment actuators if the patient support surface 312 is above a threshold maximum height. In this embodiment, if the intermediate frame is greater than 52 cm from the ground then the actuator state of the height adjustment actuators cannot be stored. This is determined from the stroke of the height adjustment actuators. If the intermediate frame 15 is at or above this height and the memory key 310 is depressed, then indicator 307 is activated to flash and a buzzer sounds while the memory key is being depressed. The controller 40 can be configured to operate in the same way if the intermediate frame 15 is below a predetermined minimum height.

The controller 40 may also be programmed to prevent storage of the state of the height adjustment actuators in step 610 dependent on the state of the deck actuators. However, in this embodiment the state of the deck actuators is not checked by the controller before storing the state of the height adjustment actuators as a desired bed egress state.

Figure 7B:
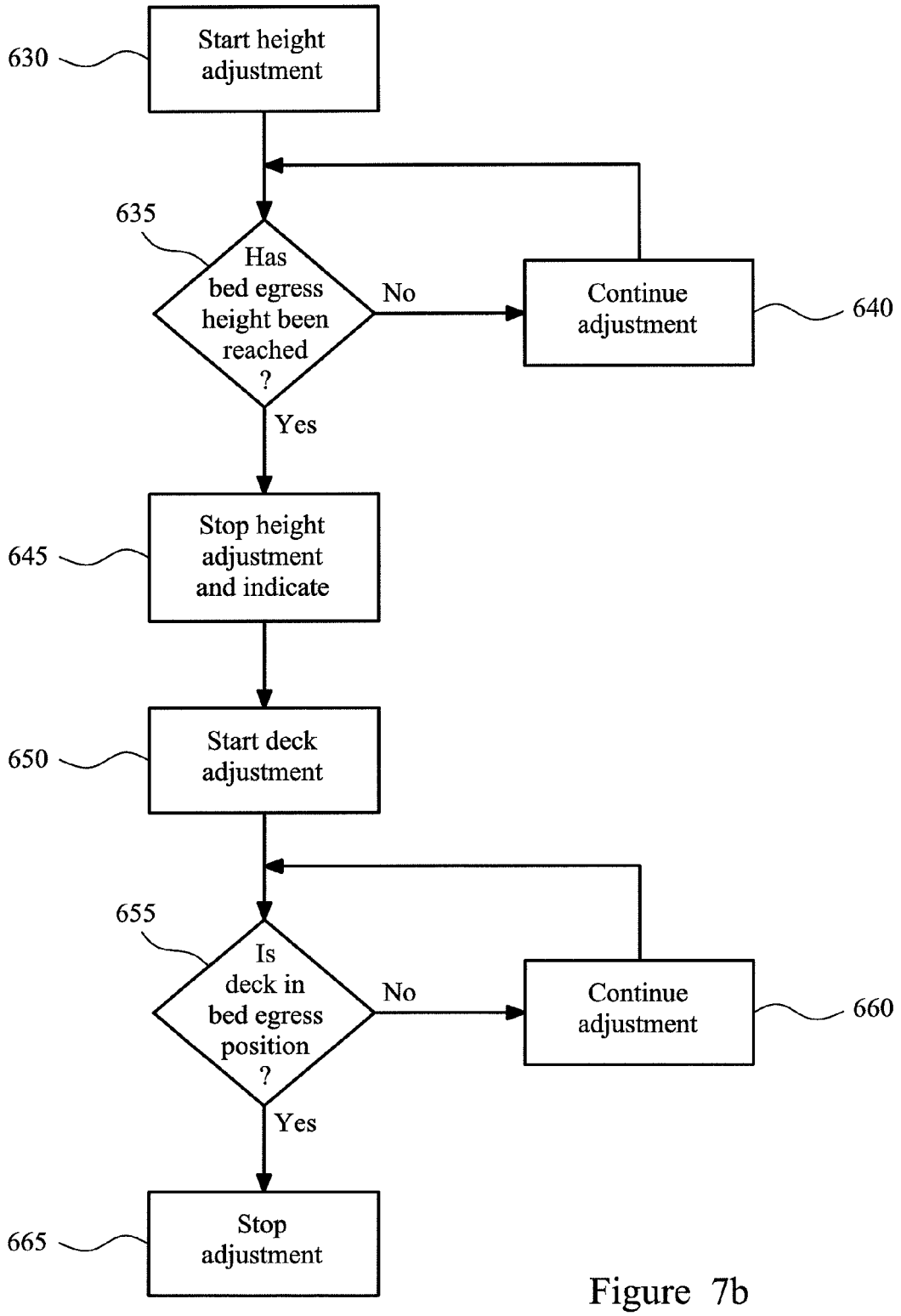
FIG. 7*b* is a flow diagram of the operation of the bed during a subsequent selection of the bed egress function.

FIG. 7*b* illustrates the operation of the bed during a subsequent selection of the bed egress function, after a bed egress height has been stored in memory. In step 630, Bed Egress is selected by the caregiver or patient depressing the Bed Egress key 324 on interface unit 32. In response to depression of the Bed Egress key, the controller 40 operates the height adjustment actuators to bring them to a bed egress position, as shown in FIG. 4. The bed egress position corresponds to the stored state for the height adjustment actuators M2 and M4 and a predetermined state for the deck actuators M1 and M3. As with other adjustment keys, the Bed Egress key 324 must be continuously depressed until the patient support surface 12 has reached the bed egress position. If the Bed Egress key 324 is released before then, the actuators will stop moving.

The controller 40 is configured to operate the height adjustment actuators M2 and M4 first until the height adjustment actuators reach the stored actuator state, corresponding to the desired height. The controller is configured to monitor the state of the height adjustment actuators in step 635 and, if they have not reached the stored state, then further adjustment is made in step 640. During the period in which the height adjustment actuators are being moved and Bed Egress key 324 depressed, the memory key indicator 312 flashes. Once the height adjustment actuators M2 and M4 have reached the stored state, further adjustment of the height adjustment actuators is stopped. This is shown in step 645. In step 645, the memory key indicator 312 stops flashing and is illuminated constantly during the adjustment of the deck actuators M1 and M3.

After the height adjustment actuators M2 and M4 have reached their stored state, the deck actuators M1 and M3 are adjusted in turn. The start of deck adjustment is shown as step 650. First, actuator M3, which moves the leg support section of the deck, is moved to a lowered position. Then actuator M1 is operated to move the head support section to a raised position, to bring the patient into a seated position. The controller 40 continues adjustment, as shown in step 660, until the deck has reached the Bed Egress position, as determined in step 655. Once the Bed Egress position is reached, the actuators stop moving, as shown as step 665. The caregiver can see this and releases the Bed Egress key 324.

Figure 8A:
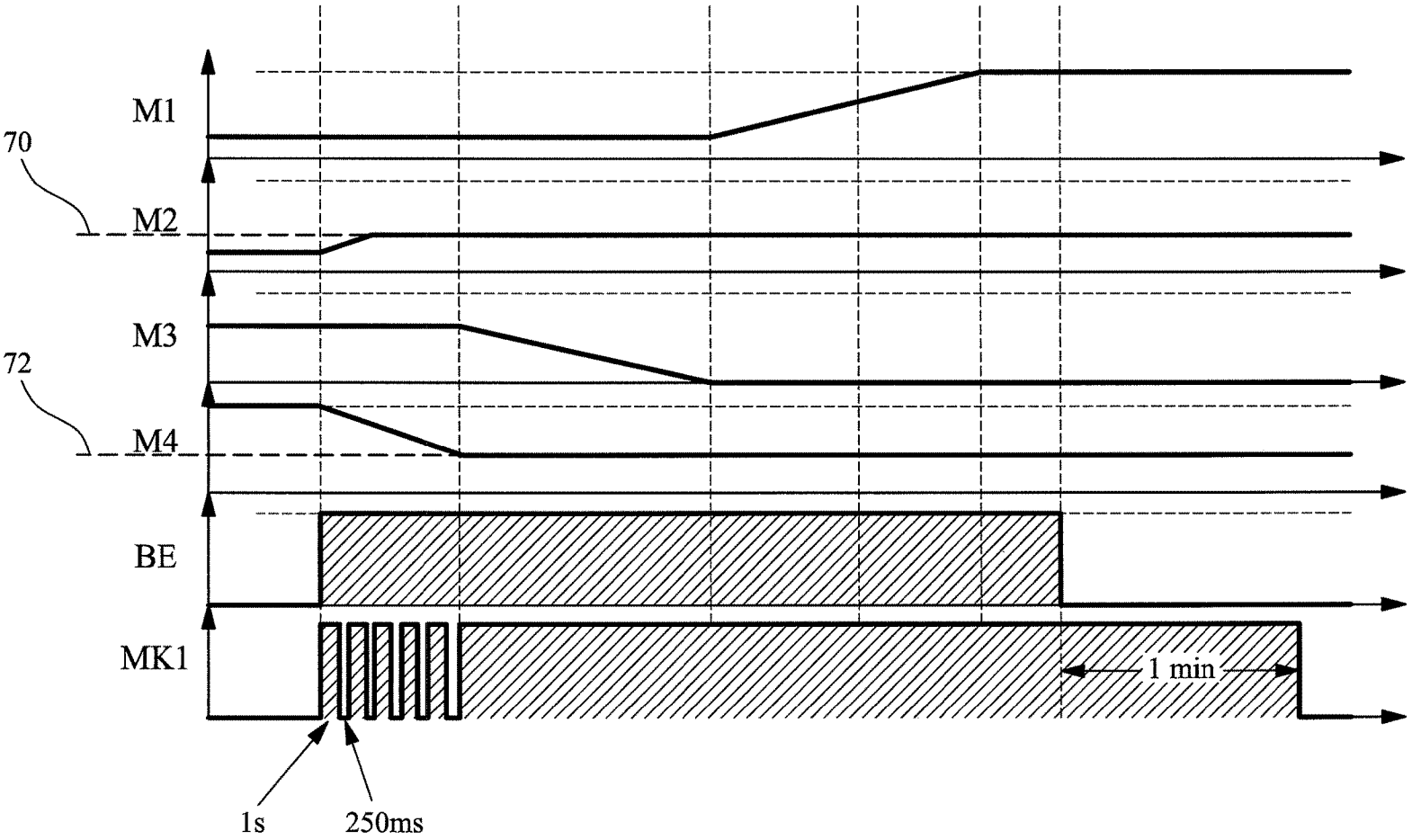
FIGS. 8*a* and 8*b* illustrate the operation of the actuators and indicator of the bed of FIG. 1 in two different scenarios.
Figure 8B:
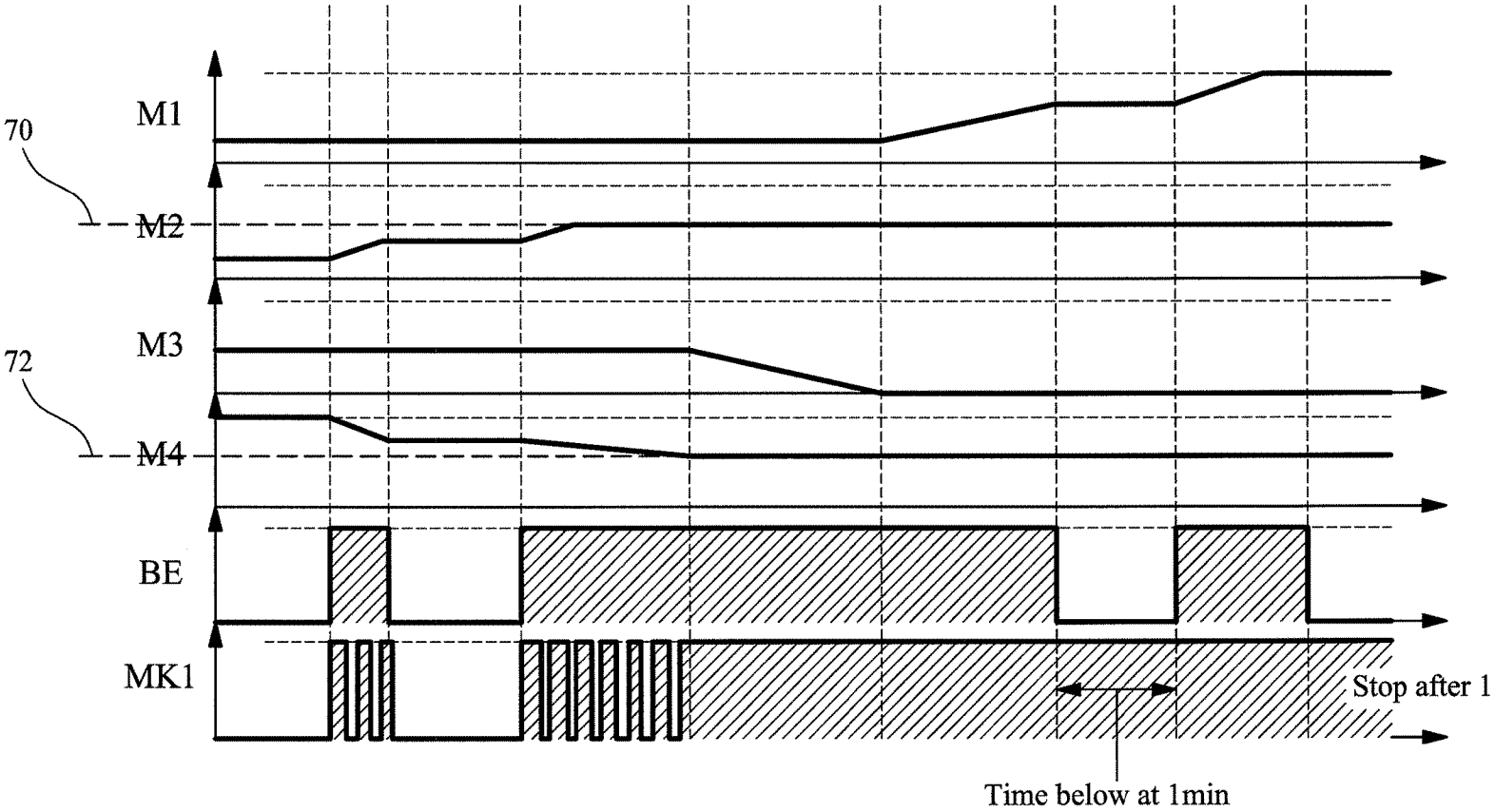

FIGS. 8*a* and 8*b* show more clearly the sequence of movement of the actuators during a bed egress adjustment process and the illumination of the memory key indicator, for two different sequences of actuation of the Bed Egress key 324.

In FIG. 8*a* the Bed Egress key is depressed continuously until the bed egress position is reached. As described in a first stage, the actuators M2 and M4 simultaneously move to the stored actuator state, so the patient support surface is at the desired height. The dotted lines 70 and 72 indicate the stored actuator states. During movement of the height adjustment actuators M2 and M4, the memory key indicator (MKI) flashes on and off. Once the stored states for M2 and M4 have been reached the memory key indicator is illuminated constantly until the bed egress position is reached and for one minute afterwards. The deck actuator M3 is then adjusted to lower the foot support section of the deck and subsequently actuator M1 operated to raise the head support section of the deck.

FIG. 8*b* shows a scenario in which the Bed Egress key is not continuously depressed. As can be seen, as soon as the Bed Egress key 324 is released, all adjustment of actuators M1, M2, M3 and M4 is stopped and the memory key indicator (MKI) is switched off. When depression of the Bed Egress key is resumed, adjustment of the actuators is resumed, in the same sequence as in FIG. 8*a*.

The controller may also be configured to indicate when the height of the patient support surface 12 is at the bed egress height when it is being adjusted using height adjustment keys 322. This is particularly beneficial if a dedicated Bed Egress key is not provided. This may be done by illuminating an indicator, such as indicator 323 on interface unit 32, by sounding an audible alarm such as buzzer, by providing a tactile alert such as a vibration through the height adjustment keys 322, by pausing the adjustment of the height adjustment actuators for a predetermined period or using a combination of one or more of these indications. For example, the controller may be configured to pause the operation of the height adjustment actuators for 10 seconds even though the height adjustment buttons continue to be depressed during that time. This provides a caregiver a simple indication that the ideal height for bed egress for the patient has been reached.

Optionally and alternatively, the deck actuators M1 and M3 are manually controlled by a caregiver and moved into the position desired for bed egress by the caregiver after the height adjustment actuators M2, M4 have reached the stored actuator state and the patient support surface is at the stored bed egress height.

Although certain illustrative embodiments have been described in detail above, variations and modifications exist within the scope and spirit of this disclosure as described and as defined in the following claims.

The invention claimed is:

1. A system for adjusting the height of a patient support surface on a bed, the system comprising: one or more bed height adjustment actuators operable to adjust a height of the patient support surface above a base frame supported on a floor surface by caster wheels, the one or more bed height adjustment actuators acting upon one or more lift arms having lower ends that are slidable along the base frame; a controller connected to the one or more height adjustment actuators, the controller including a memory; and one or more user interface units connected to the controller, wherein the controller is configured to record as a stored actuator state a current state of the one or more height adjustment actuators in the memory in response to a first input signal from the one or more interface units, wherein the stored actuator state corresponds to a user selected height that facilitates egress from a side of the bed and ingress onto the patient support surface from the side of the bed such that different users are able to select different user selected heights for ingress and egress, and is configured either to operate the one or more height adjustment actuators to automatically return them to the stored actuator state in response to a second input signal from the one or more interface units, or to provide an indication to a user when the one or more height adjustment actuators have returned to the stored actuator state, or both, wherein a height of the entirety of the one or more height adjustment actuators above the base frame is also adjusted as the height of the patient support surface is adjusted, wherein in response to the first input signal the controller is configured not to record as the stored actuator state the current state of the one or more height adjustment actuators in the memory if the patient support surface is tilted by more than 2° from a horizontal position.

2. The system of claim 1, wherein the one or more user interface units comprise a first input element, and wherein actuation of the first input element generates the first input signal.

3. The system of claim 2, wherein the first input element is a button or key for pressing by a user, patient and/or caregiver to generate the first input signal.

4. The system of claim 2, wherein the first input signal is generated only after continuous actuation of the first input element for a first period.

5. The system of claim 1, wherein the second input signal is generated in response to a request to position the patient support surface for bed egress or ingress.

6. The system of claim 5, wherein the one or more user interface units comprise a second input element, and wherein actuation of the second input element generates the second input signal.

7. The system of claim 1, wherein the one or more user interface units comprise one or more height adjustment input elements, wherein actuation of the height adjustment input elements generates a height adjustment input signal, wherein the controller is configured to operate the one or more height adjustment actuators in response to the height adjustment input signal, and wherein the indication is a pause in the operation of the height adjustment actuators while a height adjustment input signal is being generated.

8. The system of claim 1, wherein the indication comprises an audible, tactile or visual indication.

9. The system of claim 1, comprising an articulated deck on which the patient support surface is positioned, and an intermediate frame, wherein the articulated deck comprises a plurality of sections that may be moved relative to one another and are supported by the intermediate frame, wherein the one or more height adjustment actuators are arranged to adjust the height of the intermediate frame above the floor surface.

10. The system of claim 9, wherein the controller is configured to store the state of the one or more height adjustment actuators independently of a position of the sections of the deck.

11. The system of claim 9, further comprising one or more deck adjustment actuators operable to adjust the articulated deck and wherein the controller is configured to operate the one or more height adjustment actuators and the one or more deck adjustment actuators to return the one or more height adjustment actuators to the stored actuator state before the plurality of sections are moved relative to one another.

12. The system of claim 9, further comprising one or more deck adjustment actuators operable to adjust the articulated deck and wherein the controller is configured to operate the one or more height adjustment actuators and the one or more deck adjustment articulators to return the one or more height adjustment actuators to the stored actuator state such that the articulated deck is substantially flat or level until the one or more height adjustment actuators reach the stored actuator state.

13. The system of claim 9 wherein the articulated deck includes a head support section and a foot support section, the system further comprising one or more deck adjustment actuators operable to adjust the articulated deck sections and wherein the controller is connected to the one or more deck adjustment actuators and is configured to record as a stored deck adjustment actuator state a current state of the one or more deck adjustment actuators in the memory in response to a third input signal from the one or more interface units, and is configured to operate the one or more deck adjustment actuators to automatically return them to the stored deck adjustment actuator state in response to a fourth input signal from the one or more interface units.

14. The system of claim 1, wherein the controller is configured such that it does not record as a stored actuator state a current state of the one or more height adjustment actuators if a height of the patient support surface is above a maximum height threshold.

15. The system of claim 1, wherein the one or more interface units comprise a caregiver interface and a patient interface, and wherein the first input signal can be generated by the caregiver interface but cannot be generated by the patient interface.

16. The system of claim 1, wherein the stored actuator state corresponds to a desired bed egress or ingress height.

17. The system of claim 1, wherein the one or more user interface units includes a button or key, and wherein actuation of the button or key for a continuous first period generates the first input signal.

* * * * *